US011167334B2

(12) United States Patent
Gafforelli et al.

(10) Patent No.: US 11,167,334 B2
(45) Date of Patent: Nov. 9, 2021

(54) ASSEMBLY FOR MANUFACTURING A METAL PART AND USE OF SUCH AN ASSEMBLY

(71) Applicant: FAURECIA SYSTEMES D'ECHAPPEMENT, Nanterre (FR)

(72) Inventors: David Gafforelli, Audincourt (FR); Laurent Gueugnaud, Bourguignon (FR); Luc Martin, Dampierre (FR)

(73) Assignee: FAURECIA SYSTEMES D'ECHAPPEMENT

( * ) Notice: Subject to any disclaimer, the term of this patent is extended or adjusted under 35 U.S.C. 154(b) by 0 days.

(21) Appl. No.: 16/278,226

(22) Filed: Feb. 18, 2019

(65) Prior Publication Data

US 2019/0255585 A1 Aug. 22, 2019

(30) Foreign Application Priority Data

Feb. 19, 2018 (FR) ..... 18 51399

(51) Int. Cl.
*B21D 39/02* (2006.01)
*B21D 1/05* (2006.01)
*B21D 53/88* (2006.01)

(52) U.S. Cl.
CPC ..... *B21D 1/05* (2013.01); *B21D 39/02* (2013.01); *B21D 53/88* (2013.01)

(58) Field of Classification Search
CPC ..... B21D 39/02; B21D 39/028; B21D 51/28; B21D 39/023; Y10T 29/53791
USPC ..... 72/220, 51; 29/243.58
See application file for complete search history.

(56) References Cited

U.S. PATENT DOCUMENTS 1,612,519 A * 12/1926 Lindgren ..... B21D 51/28 72/51
1,643,576 A 9/1927 Colonna
2,736,284 A 2/1956 Jacokes
(Continued)

FOREIGN PATENT DOCUMENTS

DE 728114 C 11/1942
DE 10011854 A1 * 9/2001
(Continued)

OTHER PUBLICATIONS

Dictionary definition of "staple", p. 1147, Merriam-Webster's Collegiate Dictionary, 10th ed., copyright 1998.*
(Continued)

*Primary Examiner* — Erica E Cadugan
(74) *Attorney, Agent, or Firm* — Carlson, Gaskey & Olds, P.C.

(57) ABSTRACT

A manufacturing assembly for manufacturing a metal part comprises a flattening module having a trolley and at least one pressing roller. The flattening module is movable along a hemming of the metal part. The flattening module comprises at least one pressing actuator that is arranged to move the at least one pressing roller in a determined pressing direction relative to the trolley and to place the pressure roller bearing against the free surface such that the at least one pressing roller exerts pressure on the free surface in said determined pressing direction. The pressure increases auto-adaptively with an altitude of the free surface in a direction opposite the determined pressing direction.

7 Claims, 7 Drawing Sheets

(56) References Cited

U.S. PATENT DOCUMENTS

| | | | | |
|---|---|---|---|---|
| 5,228,190 | A * | 7/1993 | Sawa | B21D 39/021 29/243.57 |
| 6,640,599 | B1 * | 11/2003 | Persson | B21D 39/02 72/210 |
| 7,152,447 | B2 * | 12/2006 | Toeniskoetter | B21D 39/021 72/214 |
| 7,254,973 | B2 * | 8/2007 | Campian | B21D 39/021 29/243.58 |
| 7,290,423 | B2 * | 11/2007 | Carsley | B21D 39/023 72/214 |
| 7,637,134 | B2 * | 12/2009 | Burzlaff | B21D 39/021 29/243.58 |
| 7,779,524 | B2 * | 8/2010 | Campian | B21D 39/02 29/243.58 |
| 2005/0217339 | A1 * | 10/2005 | Toeniskoetter | B21D 39/023 72/220 |
| 2006/0225631 | A1 * | 10/2006 | Steed, Jr. | B21D 39/021 112/141 |
| 2009/0217726 | A1 * | 9/2009 | Harrow | B21D 39/021 72/214 |
| 2018/0156088 | A1 | 6/2018 | Vurpillot et al. | |

FOREIGN PATENT DOCUMENTS

| | | | | |
|---|---|---|---|---|
| DE | 202012101187 | U1 * | 8/2013 | |
| EP | 3085908 | A1 | 10/2016 | |
| FR | 2895690 | A1 * | 7/2007 | |
| FR | 3009215 | A1 * | 2/2015 | |
| FR | 3078001 | A1 * | 8/2019 | F01N 13/1816 |
| JP | 02-070325 | A * | 3/1990 | |

OTHER PUBLICATIONS

Merriam-Webster's Collegiate Dictionary, 10th ed., p. 236, definition of the term "compliance", copyright 1998.*

French Search Report for French Application No. 1851399, dated Oct. 25, 2018.

* cited by examiner

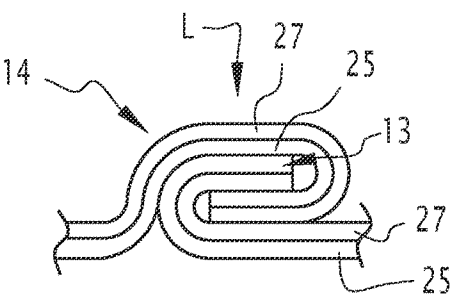
FIG.3
PRIOR ART
FIG.5
PRIOR ART
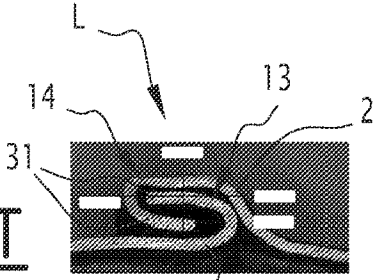
FIG.6
PRIOR ART
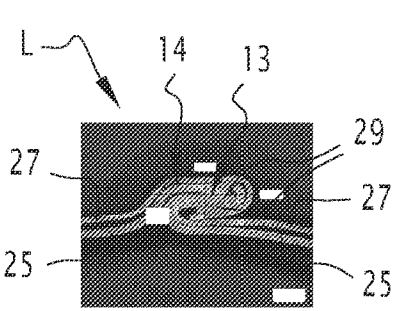
FIG.7
PRIOR ART
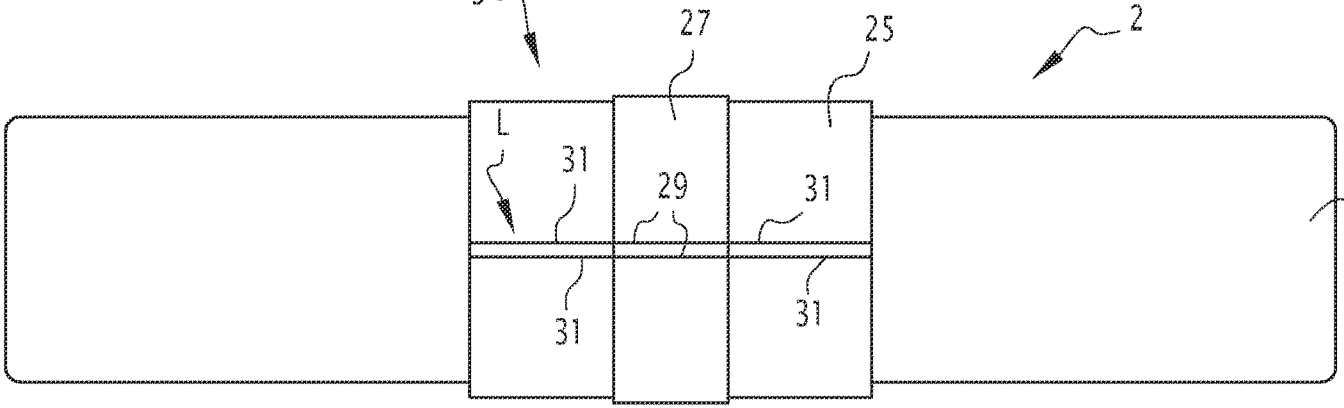
FIG.4
PRIOR ART Manufacturing Assembly In Which the Trolley Includes An Inner Cavity In Which Plural Pressing Actuators Are Housed

Fig. 15

ASSEMBLY FOR MANUFACTURING A METAL PART AND USE OF SUCH AN ASSEMBLY

CROSS-REFERENCE TO RELATED APPLICATIONS

This application is a U.S. non-provisional application claiming the benefit of French Patent Application No. 18 51399, filed on Feb. 19, 2018, which is incorporated herein by its entirety.

FIELD OF INVENTION

The invention generally relates to the manufacture of a metal part having two edges hemmed together.

BACKGROUND OF THE INVENTION

It is possible to manufacture such a metal part with a manufacturing assembly of the type shown in FIGS. 1 and 2.

The assembly 1 comprises a chassis 2 provided with a station 3 for receiving the part. To manufacture rolled parts, the receiving station 3 includes a mandrel 5.

The metal part is typically a metal sheet 6, which will gradually be rolled around the mandrel 5 (FIG. 2).

The manufacturing assembly 1 includes a moving chassis 7, moved parallel to a central axis X of the mandrel 5 relative to the chassis 2. The movement direction is embodied by arrow D in FIGS. 1 and 2.

In front, the moving chassis 7 bears a first set of hemming rollers 11.

In the present description, the front and rear are understood relative to the movement direction of the moving chassis 7 with respect to the chassis 2.

The metal sheet 6 initially has a U shape in a plane perpendicular to the central axis X. The central part of the U is pressed below the mandrel 5. The two edges 13, 14 to be hemmed are parallel to one another, as shown in FIG. 1. They are straight and parallel to the central axis X. They extend above the mandrel 5.

The rollers 11 pinch the edges 13, 14 between them and enclose the metal sheet 6 around the mandrel 5. The rollers 11 of the first set further fold the edges 13, 14 while keeping them pressed against one another.

After passage of the rollers 11, the metal sheet 6 comprises a cylindrical body 15 around the mandrel 5, the two edges 13, 14 pressed against one another extending the cylindrical body 15 and extending in a radial plane relative to the axis X.

The edge 14 has a main part 16 extending against the edge 13, extended by an end part 17 that extends radially past the edge 13. This is shown by FIG. 1, below the first set of rollers 11.

The manufacturing assembly 1 includes a second set of rollers 18, mounted on the moving chassis 7 immediately behind the first set of rollers 11.

The second set of rollers 18 are arranged so as to fold the end part 17 substantially at a right angle relative to the edge 13 and the main part 16 of the edge 14. The end part 17 is bent on the side of the edge 13, as shown in FIG. 1, below the second set of rollers 18.

The manufacturing assembly 1 also includes a third set of rollers 19, mounted on the moving chassis 7 immediately behind the second set of rollers 18. The third set of rollers 19 are arranged so as to fold the end part 17 completely along the edge 13. Thus, the main part 16 of the edge 14 extends on one side of the edge 13, and the end part 17 of the edge 14 extends on the side opposite the edge 13. In other words, the edge 14 is bent in a U, the edge 13 being engaged inside the U. The end part 17, the edge 13, and the main part 16 therefore form a stack with three superimposed thicknesses.

The rollers 19 are also arranged so as to fold said stack down toward the cylindrical body 15. This is shown by FIG. 1, below the third set of rollers 19. The bending direction is chosen such that the end part 17 of the edge 14 is placed opposite the cylindrical body 15. In the illustrated example, the stack is bent at about 60° relative to the radial direction.

After the passage of the third of the various sets of rollers 19, the two edges 13, 14 are hemmed to one another. The two edges 13, 14 hemmed to one another define a hemming line L.

The manufacturing assembly 1 further includes a flattening module 20, comprising a set of pressing rollers 21 mounted on a trolley 23. The flattening module 20 is mounted on the moving chassis 7, immediately behind the third set of rollers 19.

Each pressing roller 21 is arranged to exert pressure in a pressing direction along the hemming line L. This pressing direction is, for example, radial.

This results in completely folding the stack down against the cylindrical body 15, by pressing the end part 17 against the cylindrical body 15.

Furthermore, the pressing force exerted by the pressing rollers 21 makes it possible to deform the metal making up the metal sheet 6 such that the end part 17 is pressed against the cylindrical body 15, the edge 13 is pressed against the end part 17, and the intermediate part 16 is pressed against the edge 13. The pressure exerted by the rollers 21 is such that the hem thus produced retains its shape, even once the rollers 21 have passed. This hem is shown more precisely in FIG. 3.

One can see that the edges 13 and 14 have each been bent in a U, when considered perpendicular to the central axis X, the Us being turned in opposite directions and interleaved in one another. The different thicknesses are pressed against one another.

The part thus formed is typically intended to form the outer enclosure of a member of an exhaust line, such as a muffler. The exhaust gases therefore circulate inside said part. For the normal exhaust gas pressures inside the part, the hem made as described above must guarantee a low leak rate of the exhaust gases toward the outside of the part.

EP 3,085,908 describes a metal part forming an exhaust volume. This metal part includes a main metal sheet 25 and a partial metal sheet 27, superimposed on one another, as shown in FIG. 4. The partial metal sheet 27 only covers part of the surface of the main metal sheet 25.

The main 25 and partial 27 metal sheets are wound together, and the two edges 13 and 14 of the part are hemmed to one another.

Each edge 13, 14 thus includes a fixed segment 29, along which the main metal sheet 25 is covered by the secondary metal sheet 27, and at least one thin segment 31, along which the main metal sheet 25 is not covered by the secondary metal sheet 27.

In the example of FIG. 4, the fixed segment 29 of each edge 13, 14 is framed by two thin segments 31.

The two edges 13, 14 can be hemmed to one another by using the manufacturing assembly 1 shown in FIG. 1. The thick segments 29 of the two edges 13, 14 are hemmed to one another. The or each thin segment 31 of the edge 13 is hemmed to a thin segment 31 of the other edge 14.

The two edges 13, 14 hemmed to one another thus form a hemming line L that is formed differently along thick segments 29 and along thin segments 31.

The thin segments 31 form a first section of the hemming line L, which, considered in section, behaves as shown in FIG. 3. The thick segments 29 form a second section of the hemming line L, which, considered in section, is of the type shown in FIG. 5. The second section of the hemming line L is thicker than the first section.

For metal parts of the type shown in FIG. 4, it is difficult to obtain a leak rate satisfying the specifications of motor vehicle builders when the part is hemmed with an assembly of the type shown in FIG. 1.

FIGS. 3 and 5 are block diagrams showing the theoretical shapes desired for the cross-sections of the first and second sections. FIGS. 6 and 7 are views showing the cross-sections actually obtained with the manufacturing assembly 1 of FIG. 1.

At the second section, joining the thick segments 29 of the edges 13, 14, one can see that the hemming line L is well-formed, as illustrated in FIG. 7. The different thicknesses are indeed pressed against one another, such that the exhaust gas leak rate along said second section is minimal.

Along the first section(s), joining the thin segments 31 to one another, one can see that the hemming line L is poorly formed, as illustrated in FIG. 6. The different thicknesses of the hemming line L are pressed against one another poorly or not at all. The exhaust gas leak rate along the first section(s) is high. In total, it is extremely difficult to meet the requirements of motor vehicle builders for the metal parts thus formed, due to the poor exhaust gas tightness along the first section(s) of the hemming line L.

SUMMARY OF THE INVENTION

In this context, the invention aims to propose an assembly for manufacturing a metal part that does not have the above flaws.

To that end, the invention relates to an assembly for manufacturing a metal part comprising a chassis provided with a station that receives the metal part and a flattening module comprising a trolley and at least one pressing roller connected to the trolley. The metal part has two edges hemmed to one another, the two edges hemmed to one another defining a hemming line having a free surface. The manufacturing assembly comprises a longitudinal drive arranged to move the flattening module relative to the chassis along the hemming line when the metal part is at the station. The flattening module comprises at least one pressing actuator that is arranged to move the at least one pressing roller in a determined pressing direction relative to the trolley and to place the pressing roller bearing against the free surface such that the at least one pressing roller exerts pressure on the free surface in said determined pressing direction. The pressure increases auto-adaptively with an altitude of the free surface in a direction opposite the determined pressing direction.

Because the pressing roller is movable relative to the trolley, it is always positioned correctly heightwise relative to the free surface of the hemming line. Furthermore, the pressure exerted by the pressing roller(s) increases with the altitude of the free surface in the direction opposite the pressing direction. Thus, the pressure exerted on the hemming line is greater when the hemming line is thicker and lower when the hemming line is thinner. When it is thicker, the hemming line is more difficult to deform, and it is therefore necessary to exert greater pressure on it to press the different thicknesses of metal against one another, by plastic deformation.

In the invention, the pressure exerted depends on the altitude of the free surface, this altitude being considered to reflect the thickness of the hemming line. This is particularly advantageous in the case where the part is rolled around a mandrel. In such a configuration, a greater thickness of the hemming line is reflected by a higher altitude of the free surface of the hemming line relative to the surface of the mandrel.

The fact that the pressure increases auto-adaptively with the altitude of the free surface causes the manufacturing assembly to be particularly easy to implement. "Auto-adaptive" means that the pressure increases directly in response to the altitude of the free surface. This adjustment is done passively. It is not necessary, during a first step of the method, to record the altitude profile of the hemming line, then to control the actuator such that it exerts a pressure calculated as a function of the recorded altitude. A single passage of the flattening module is sufficient to obtain the desired result.

To manufacture a part of the type shown in FIG. 4, the pressing roller(s) adopt a lower position along the first section than along the second section, and exert a higher pressure along the second section than along the first section.

With the manufacturing assembly according to FIG. 1, the height of the pressing rollers is calibrated on the altitude of the free surface along the second section. The second section of the hemming line is therefore well-formed. Conversely, because the altitude of the free surface is lower along the first section, the pressure exerted on the first section is very low, or even nonexistent. This results from the fact that the rollers are not movable relative to the trolley on which they are mounted. They are shimmed at an inappropriate height for the formation of the first section, with no possibility of adjustment.

The manufacturing assembly may also have one or more of the features below, considered individually or according to any technical possible combination(s):

- the or each actuator is a resilient compression member having a compression axis combined with the pressing direction;
- the resilient compression member comprises a body having a bottom and a piston connected to the at least one pressing roller and movable inside the body in the pressing direction, a sealed chamber including a pressurized gas being delimited between the bottom and the piston;
- the trolley comprises, for the or each pressing actuator, an inner cavity in which said pressing actuator is housed, a rotational guide bearing of the corresponding pressing roller being secured to the piston and housed in the inner cavity;
- a lower bottom delimits the inner cavity in the pressing direction and limits the travel of the pressing roller in the pressing direction;
- the manufacturing assembly comprises a hemming unit, arranged to hem the two edges of the metal part to one another;
- the hemming unit and the flattening module are mounted on a same moving chassis, moved along the hemming line by the longitudinal drive.

According to a second aspect, the invention relates to the use of the manufacturing assembly described above, to manufacture a metal part whereof the hemming line has a first section along which the altitude of the free surface is relatively less high, and a second section along which the altitude of the free surface is relatively higher, the pressing roller exerting a first pressure along the first section and a second pressure greater than the first pressure along the second section.

This use may also have one or more of the features below, considered individually or according to any technical possible combination(s):

- the metal part comprises a primary metal sheet and a secondary metal sheet pressed on the primary metal sheet and covering only part of the primary metal sheet, at least one of the two edges having at least one thin segment, forming the first section of the hemming line, along which the primary metal sheet is not covered by the secondary metal sheet, and at least one thick segment, forming the second section of the hemming line, along which the primary metal sheet is covered by the secondary metal sheet;
- the metal part is a hollow volume of an exhaust line, the hemming line after flattening having a leak rate of less than 30 l/min, preferably less than 15 l/min, and still more preferably less than 10 l/min;
- the part is rolled, the two edges hemmed to one another being straight.

BRIEF DESCRIPTION OF THE DRAWINGS

Other features and advantages of the invention will emerge from the detailed description thereof provided below, for information and non-limitingly, in reference to the appended figures, in which:

FIG. 3 is a schematic sectional illustration of the hemming line of the part of FIG. 2;

FIG. 4 is a view similar to that of FIG. 2, for a metal part including a primary metal sheet and a partial metal sheet;

FIG. 5 is a schematic sectional illustration of the hemming line of the part of FIG. 4, considered in a section where the primary metal sheet and the partial metal sheet are superimposed;

FIGS. 6 and 7 are sectional views showing the actual state of the hemming line obtained when the manufacturing assembly of FIG. 1 is used for a part of the type shown in FIG. 4;

FIG. 15 schematically shows an alternative configuration of the manufacturing assembly.

DETAILED DESCRIPTION

Figure 1:
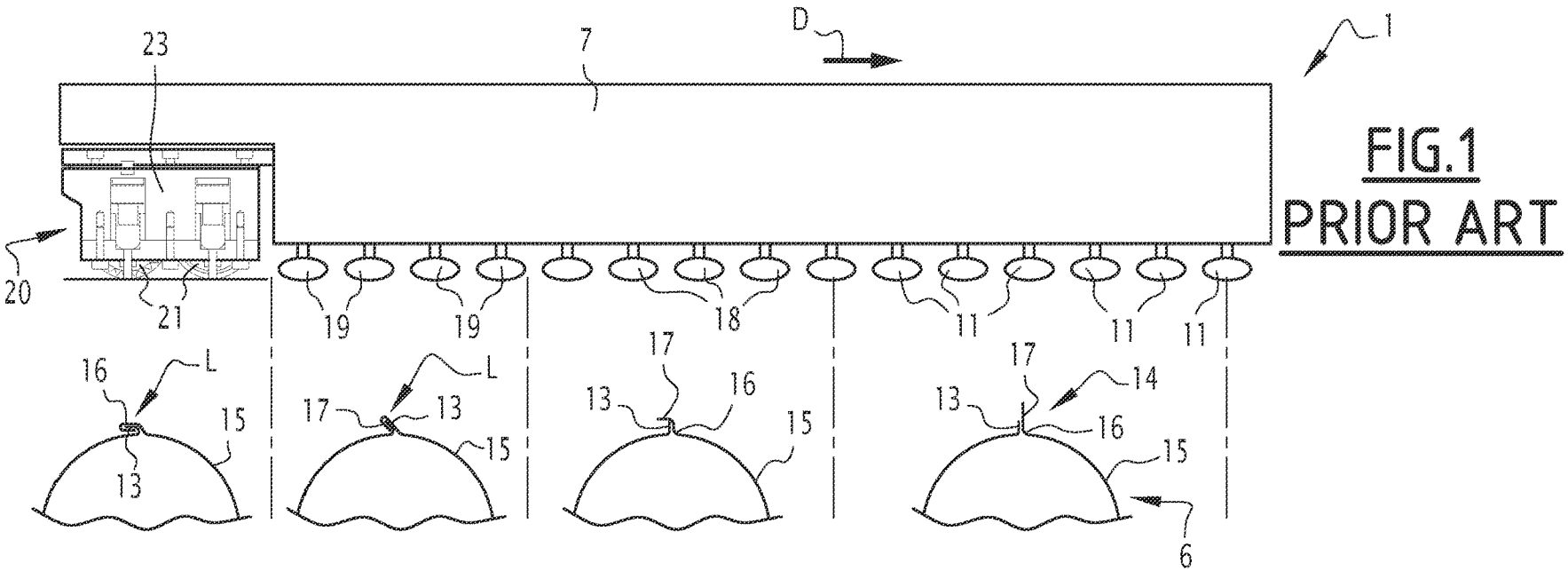
FIG.1 PRIOR ART
FIG. 1 is an illustration of a manufacturing assembly for a metal part not according to the invention.
Figure 2:
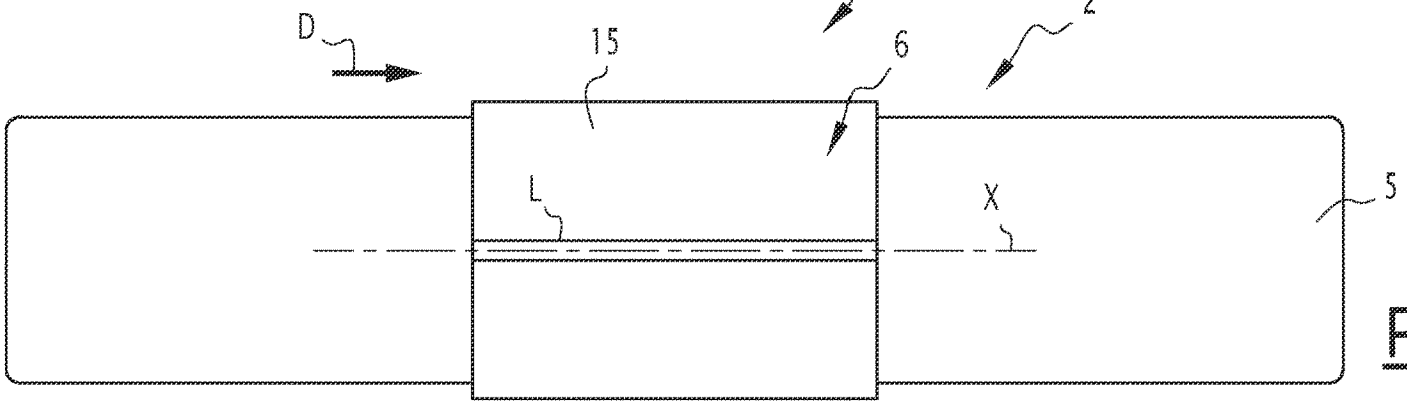
FIG.2 PRIOR ART
FIG. 2 is a view of the metal part obtained using the manufacturing assembly of FIG. 1, mounted around a mandrel.

A manufacturing assembly 33 shown in FIGS. 8 to 11 is provided to manufacture a metal part 35 (FIG. 11), typically a metal part of an exhaust line of a vehicle with a heat engine. This vehicle is typically a motor vehicle, for example a car or truck.

The metal part 35 has two edges hemmed to one another, the two edges hemmed to one another defining a hemming line 37 having a free surface 39.

The metal part 35 typically forms a hollow body 40, inwardly delimiting a volume traveled by the exhaust gases.

The metal part 35 is typically formed by a metal blank rolled around a central axis. The metal blank defines the two edges hemmed to one another. In this case, the edges are straight and parallel to one another.

Alternatively, the metal part 35 is not rolled, but is for example formed by at least two shell parts, each shell part defining one of the two edges. For example, the metal part 35 is formed by two half-shells. The two half-shells in this case are hemmed to one another via their respective edges. In this case, each edge typically has a closed contour.

According to another alternative, the metal part 35 could be formed from a plurality of shell parts.

Figure 11:
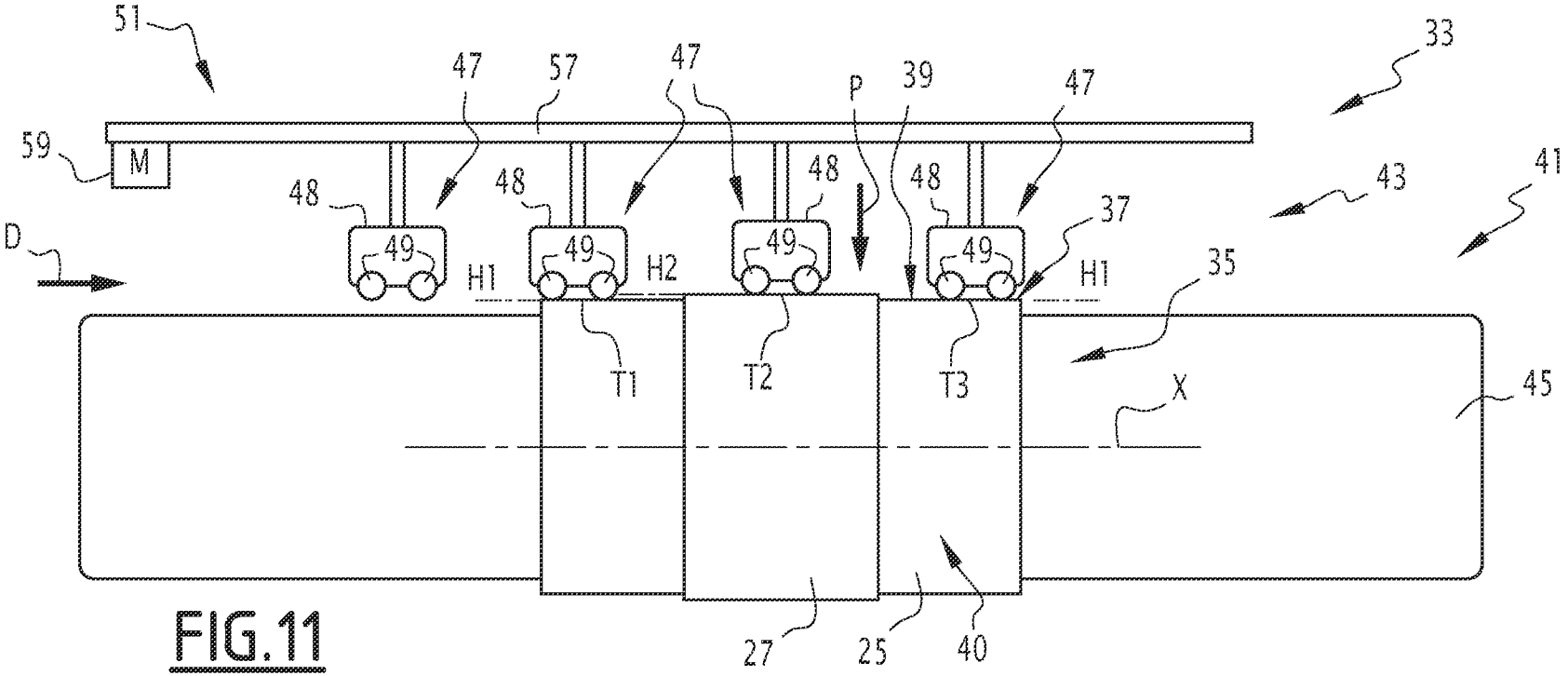
FIG. 11 schematically shows the operation of the flattening module of FIGS. 8 to 10, for a metal part of the type shown in FIG. 4.
Figure 14:
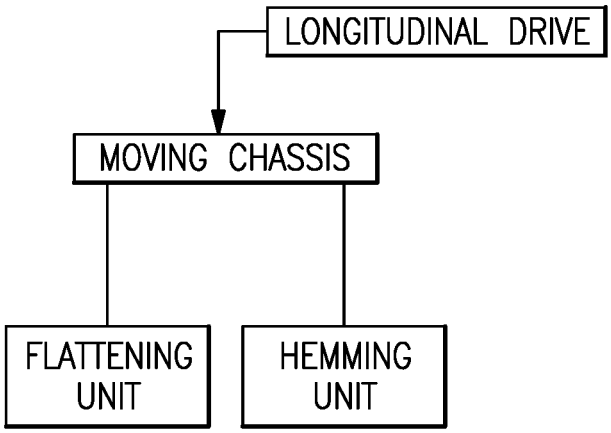
FIG. 14 schematically shows an example of a hemming unit.

The manufacturing assembly 33 comprises a chassis 41 provided with a station 43 for receiving the metal part 35 (FIG. 11).

In the case where the metal part 35 is of the rolled type, the receiving station 43 includes a mandrel 45 around which the metal part 35 is slipped.

The mandrel 45 is a cylindrical part, having a central axis X. It has a section corresponding to the section of the metal part 35, for example circular or triangular.

In this case, the metal part 35 is pressed against the outer surface of the mandrel 45.

The hemming line 37 is typically straight and extends parallel to the central axis X. The free surface 39 of the hemming line 37 is turned away from the mandrel 45.

Typically, the metal part 35 is obtained by rolling a metal stream around the mandrel 45, as described above.

Typically, the manufacturing assembly 33 includes a lock (not shown) to hold the part in position at the receiving station. The lock, for example, can include clamps, or gripping rings, or any other appropriate member.

Figure 9:
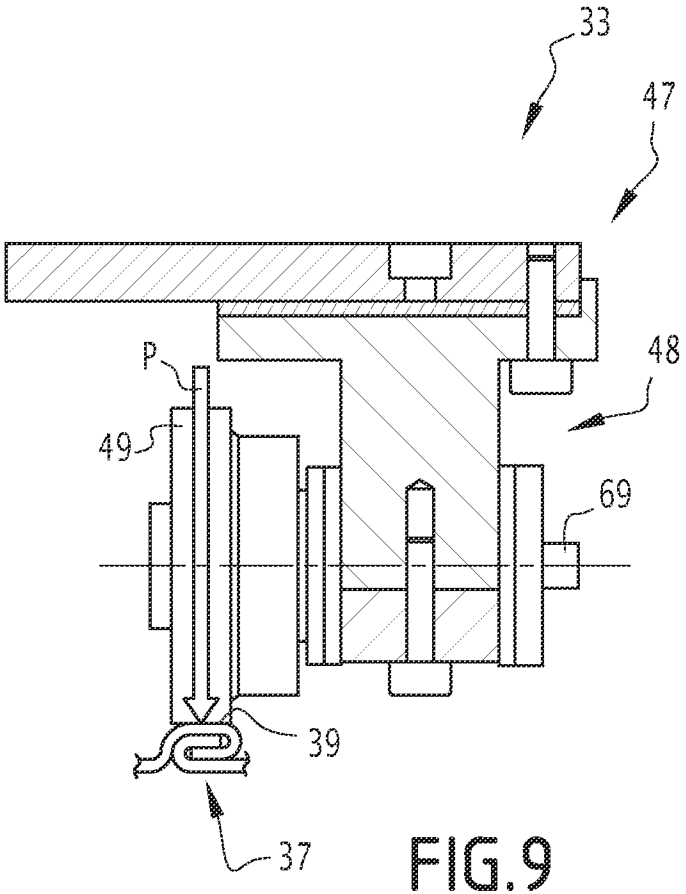
FIG. 9 is a front view of the flattening module of FIG. 8.
Figure 8:
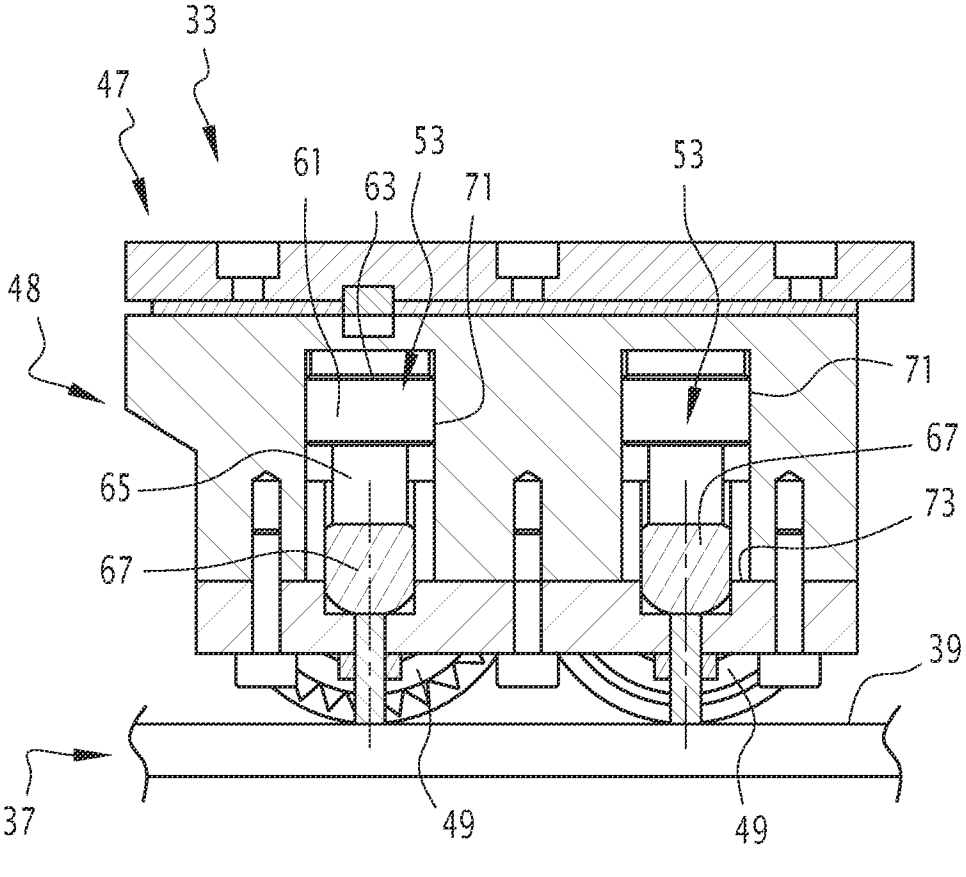
FIG. 8 is a side view of a flattening module of a manufacturing assembly according to the invention.
Figure 10:
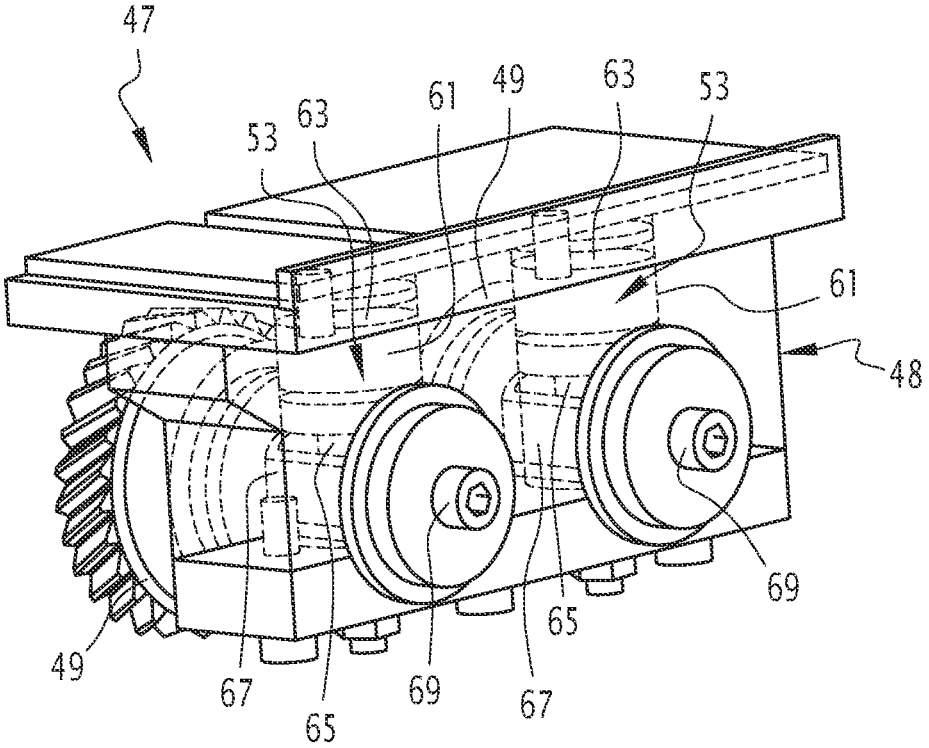
FIG. 10 is a perspective view of the flattening module of FIGS. 8 and 9, the trolley being shown transparent.

The manufacturing assembly 33 further includes a flattening module 47, shown in detail in FIGS. 8 to 10.

The flattening module 47 is provided to flatten the hemming line 37. It therefore performs the same function as the flattening module 20 of the manufacturing assembly 1 of FIG. 1.

In other words, it makes it possible to completely fold down the two edges hemmed to one another against the body of the metal part, and to flatten the different thicknesses making up the hemming line so as to guarantee satisfactory tightness with respect to the exhaust gases along the hemming line.

The flattening module 47 includes a trolley 48, and at least one pressing roller 49 connected to the trolley 48.

The manufacturing assembly 33 includes a longitudinal drive 51 (FIG. 11) arranged to move the flattening module 47 relative to the chassis 41 along the hemming line 37 when the metal part 35 is loaded in the receiving station 43.

In the illustrated example, the flattening module 47 includes two rollers 49, mounted one behind the other in the movement direction of the flattening module 47 along the hemming line 37. Alternatively, the flattening module 47 includes a single roller, or more than two rollers, for example three rollers.

According to the invention, the flattening module 47 includes at least one pressing actuator 53, arranged to move the at least one pressing roller 49 in a determined pressing direction relative to the trolley 48 and to place it bearing against the free surface 39 such that the at least one pressing roller 49 exerts pressure on the free surface 39 in said determined pressing direction, the pressure increasing auto-adaptively with an altitude of the free surface 39 in a direction opposite the pressing direction.

The pressing direction is shown by arrow P in FIGS. 9 and 11.

Typically, each pressing roller 49 is connected to the trolley 48 by a dedicated pressing actuator 53.

The longitudinal drive 51 is of any suitable type. It, for example, includes a rail 57 extending parallel to the hemming line 37, the trolley 48 being mounted sliding along the rail 57. The longitudinal drive 51 also includes a motor 59 that drives the trolley 48 along the rail 57 via a chain or any other appropriate member.

The pressing actuator 53 is typically a resilient compression member, having a compression axis combined with the pressing direction.

Advantageously, the resilient compression member is a gas cylinder.

In this case, the gas cylinder includes a body 61 having a bottom 63, and a piston 65 connected to the corresponding pressing roller 49. The piston 65 is movable inside the body 61 in the pressing direction. A tight chamber containing a pressurized gas is delimited between the bottom 63 and the piston 65.

When the piston 65 approaches the bottom 63, the gas contained in the chamber is compressed, and the pressure exerted by the resilient member on the pressing roller 49 in the pressing direction increases. Conversely, when the piston 65 moves away from the bottom 63, the gas pressure decreases in the chamber, and the pressure exerted by the resilient member on the pressing roller 49 decreases.

The flattening module 47 includes, for the or each pressing roller 49, a bearing 67, secured to the piston 65. The roller 49 is rigidly fastened to a shaft 69, which is guided in rotation by the bearing 67.

Typically, the trolley 48 comprises, for the or each pressing actuator 53, an inner cavity 71 in which said pressing actuator 53 and the bearing 67 are received. The pressing actuator 53 is rigidly fastened to the trolley 48, inside the inner cavity 71. The bearing 67 moves with the piston 65 inside the inner cavity 71. Bearing and piston travel in the pressing direction is limited by the lower bottom 73 of the inner cavity 71.

Typically, the trolley 48 includes an inner cavity 71 for each pressing actuator 53. Alternatively, as schematically shown in FIG. 15, several pressing actuators 53 are housed in the same inner cavity 71.

The shaft 69 extends in a direction perpendicular to the pressing direction. The shaft 69 passes all the way through the trolley 48.

Alternatively, the resilient compression member is not a gas cylinder, but is a compression spring, for example a helical spring, or a slab of an elastomeric material or any other appropriate resilient member.

Advantageously, the manufacturing assembly 1 comprises a hemming unit, arranged to hem the two edges of the part to one another and forming the hemming line 37.

Typically, the hemming unit, for example, includes one or several sets of rollers 11, 18, 19 of the type described relative to FIG. 1.

Advantageously, the trolley 48 is rigidly fastened to a moving chassis bearing the hemming unit. In this case, the longitudinal drive 51 is arranged to move the moving chassis along the hemming line 37.

Alternatively, the longitudinal drive 51 moves the flattening module 47 independently of the unit having served to produce the hemming line.

It is therefore understood that it is particularly advantageous to use the assembly 33 described above to manufacture a part whereof the hemming line 37 has a first section T1 along which the altitude of the free surface 39 is relatively less high, and a second section T2 along which the altitude of the free surface 39 is relatively higher.

This part is, for example, the part described above in reference to FIG. 4. This part comprises a primary metal sheet 25 and a secondary metal sheet 27 pressed on the primary metal sheet 25 and covering only part of the primary metal sheet 25.

At least one of the two edges has at least one thin segment 31 along which the primary metal sheet 25 is not covered by the secondary metal sheet 27. This edge also has at least one thick segment 29 along which the primary metal sheet 25 is covered by the secondary metal sheet 27.

For example, each edge has two thin segments 31, arranged on either side of the thick segment 29.

Along the hemming line 37, each thin segment 31 of one of the two edges is hemmed with a thin segment 31 of the other edge. Each thick segment 29 of one of the edges is hemmed with a thick segment 29 of the other edge.

The thick segments 29 form the second section T2.

The thin segments 31 form the first section T1. They, for example, also form a third section T3 along which the altitude of the free surface 39 is substantially the same as along the first section T1. The sections T1 and T3 are located on either side of the second section T2 of the hemming line 37.

FIG. 11 illustrates why the pressing actuator 53 makes it possible to increase the pressure exerted by the pressing roller 49 on the free surface 39, auto-adaptively with the altitude of the free surface 39 in a direction opposite the pressing direction, for such a part.

In FIG. 11, the movement direction of the flattening module 47 is embodied by the arrow D. The altitude of the free surface 39 in the direction opposite the pressing direction may be taken relative to any reference surface. For example, it may be taken relative to the outer surface of the mandrel.

Before the pressing roller 49 is in contact with the hemming line 37, the pressing actuator 53 applies a predetermined pressure P0 to the pressing roller 49.

Under the effect of this pressure, the bearing 67 abuts against the lower bottom 73 of the inner cavity 71. This determines the position of the pressing roller 49 in the pressing direction. This situation is illustrated in the left part of FIG. 11.

When the pressing roller 49 bears against the first section T1 of the free surface 39, located at an altitude H1, the pressing roller 49 is moved relative to the trolley 48 in a direction opposite the pressing direction P. The pressure exerted by the pressing actuator 53 on the pressing roller 49 in the pressing direction P increases to a pressure P1, greater than the pressure P0.

This is obtained auto-adaptively, and results from the fact that the gas located in the sealed chamber of the pressing actuator is compressed due to the movement of the piston 65. The pressure increase occurs passively, without any automatism, or sophisticated steering member.

This situation is shown in the middle on the left in FIG. 11.

When the pressing roller 49 moves in contact with the second section T2 of the free surface 39, located at an altitude H2 greater than the altitude H1, the pressing roller 49 is offset in a direction opposite the pressing direction relative to the first section T1. The pressure exerted by the pressing actuator 53 on the pressing roller 49 therefore increases to a pressure P2 greater than the pressure P1.

This results from the movement of the piston 65 toward the bottom 63, which increases the gas pressure in the tight chamber. This increase in the pressure exerted on the pressing roller 49, and therefore the pressure exerted by the pressing roller 49 on the free surface 39 of the hemming line 37, is auto-adaptive.

This situation is shown in the middle on the right in FIG. 11.

When the pressing roller 49 arrives at the third section T3, located at the first altitude H1, the pressure exerted by the pressing actuator 53 on the pressing roller 49 in the pressing direction automatically returns to the value P1.

This situation is illustrated in the right part of FIG. 11.

Figure 13:
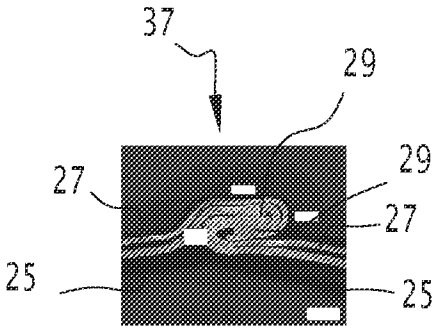
FIGS. 12 and 13 are views similar to those of FIGS. 6 and 7, illustrating the actual state of the hemming line obtained when a part is formed of the type of that of FIG. 4 with a manufacturing assembly according to FIGS. 8 to 10.
Figure 12:
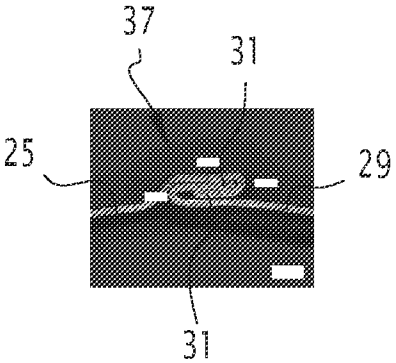

FIGS. 12 and 13 show the results obtained for such a part, when the manufacturing assembly 33 according to the invention is used for the hemming of the part.

FIG. 13 shows, in sectional view in a plane perpendicular to the movement direction, how the second section T2 is formed. One can see that the hemming line 37 is well-formed, the different thicknesses making up the two edges being in close contact with one another.

FIG. 12 is a sectional view taken along the first section T1. One can see that the quality of the hemming is much better than that obtained in FIG. 6.

In FIGS. 6 and 7, the hemming line L had been flattened with a manufacturing assembly shimmed to exert a predetermined force in the pressing direction on a free surface situated at a height H2. Along the second section, the hemming line is well-formed. Conversely, the pressure exerted on the first section of the hemming line L is too weak, since this first section is situated at a height H1 lower than the height H2. As a result, in the device of FIG. 1, due to the absence of a pressing actuator, it is not possible to obtain a good quality hemming line.

With the manufacturing assembly 33 according to the invention, it is possible to obtain a part forming a hollow volume of an exhaust line, the hemming line 37 after flattening having a leak rate of less than 30 l/min, preferably less than 15 l/min, and still more preferably less than 10 l/min.

This leak rate is measured under standard conditions.

The manufacturing assembly 33 may have multiple alternatives.

According to one alternative embodiment, it is designed to process a metal part that is already hemmed. In this case, the manufacturing assembly does not include the hemming unit. Alternatively, it includes both the pressing module and the hemming unit.

According to one alternative embodiment, each pressing roller is mounted rotating around a stationary shaft. This shaft is then rigidly fastened to the pressing actuator, using any appropriate means.

The assembly is well suited to manufacturing a part whereof the hemming line has any type of shape. It is straight, or bowed in a plane, or follows a three-dimensional shape.

The first and second sections of the hemming line do not necessarily follow a rising step, as described above. Alternatively, they follow a descending step. According to another alternative, each section has a variable height, rising uniformly or descending uniformly or alternately rising and descending. The considered height for each section is then the average height.

The metal part does not necessarily include a primary metal sheet and a secondary metal sheet only partially covering the primary metal sheet. The thin and thick segments of the edges alternatively belong to zones with different thicknesses of the same metal sheet. According to another alternative, the thin and thick segments of the edges belong to different metal sheets juxtaposed alongside one another.

Although an embodiment of this invention has been disclosed, a worker of ordinary skill in this art would recognize that certain modifications would come within the scope of this disclosure. For that reason, the following claims should be studied to determine the true scope and content of this disclosure.

The invention claimed is:

1. A manufacturing assembly for manufacturing a metal part, the manufacturing assembly comprising:

a chassis provided with a station that receives the metal part;

a flattening module that includes a trolley and the flattening module including at least one pressing roller connected to the trolley, the metal part having two edges hemmed to one another, the two edges hemmed to one another defining a hemming line having a free surface;

a longitudinal drive arranged to move the flattening module relative to the chassis along the hemming line when the metal part is at the station; and the flattening module including at least one pressing actuator that is arranged to move the at least one pressing roller in a determined pressing direction relative to the trolley and to place the at least one pressing roller to bear against the free surface such that the at least one pressing roller exerts pressure on the free surface in said determined pressing direction, the pressure increasing auto-adaptively with an altitude of the free surface that increases in a direction opposite the determined pressing direction, and wherein the at least one pressing actuator or each pressing actuator is a resilient compression member;

wherein the resilient compression member or each resilient compression member includes:

a body having a bottom, and a piston movable inside the body in the determined pressing direction relative to the bottom, and wherein a sealed chamber including a pressurized gas is delimited between the bottom and the piston; and wherein the trolley, for the at least one pressing actuator or each pressing actuator includes:

an inner cavity in which the at least one pressing actuator is housed, or a plurality of inner cavities where each pressing actuator is housed in one inner cavity of the plurality of cavities, or an inner cavity in which each pressing actuator is housed, and a rotational guide bearing for each piston.

2. The assembly according to claim 1, wherein the resilient compression member has a compression axis that extends in a direction common with the determined pressing direction.

3. The assembly according to claim 1, wherein a lower bottom delimits the inner cavity or wherein a respective lower bottom delimits each inner cavity of the plurality of cavities, in the determined pressing direction and limits travel of the at least one pressing roller or each pressing roller in the determined pressing direction.

4. The assembly according the claim 1, wherein the manufacturing assembly comprises a hemming unit, arranged to hem the two edges of the metal part to one another.

5. The assembly according the claim 1, wherein the pressure increases directly in response to the altitude of the free surface increasing in the direction opposite the determined pressing direction.

6. The assembly according the claim 1, wherein the pressure increases passively in response to the altitude of the free surface increasing in the direction opposite the determined pressing direction.

7. A manufacturing assembly for manufacturing a metal part, the manufacturing assembly comprising:

a chassis provided with a station that receives the metal part;

a flattening module that includes a trolley, and the flattening module including at least one pressing roller connected to the trolley, the metal part having two edges hemmed to one another, the two edges hemmed to one another defining a hemming line having a free surface;

a longitudinal drive arranged to move the flattening module relative to the chassis along the hemming line when the metal part is at the station; and the flattening module including at least one pressing actuator that is arranged to move the at least one pressing roller in a determined pressing direction relative to the trolley and to place the at least one pressing roller to bear against the free surface such that the at least one pressing roller exerts pressure on the free surface in said determined pressing direction, the pressure increasing auto-adaptively with an altitude of the free surface that increases in a direction opposite the determined pressing direction;

wherein the at least one pressing actuator or each pressing actuator is a resilient compression member having a compression axis that extends in a direction common with the determined pressing direction;

wherein the resilient compression member or each resilient compression member includes:

a body having a bottom, and a piston movable inside the body in the determined pressing direction relative to the bottom; and wherein a sealed chamber including a pressurized gas is delimited between the bottom and the piston;

wherein the trolley, for the at least one pressing actuator or each pressing actuator includes:

an inner cavity in which the at least one pressing actuator is housed, or a plurality of inner cavities where each pressing actuator is housed in one inner cavity of the plurality of cavities, or an inner cavity in which each pressing actuator is housed, and a rotational guide bearing for each piston;

wherein a lower bottom delimits the inner cavity in the determined pressing direction and limits travel of the at least one pressing roller in the determined pressing direction, or wherein a respective lower bottom delimits each inner cavity of the plurality of cavities in the determined pressing direction and limits travel of each pressing roller in the determined pressing direction; and wherein the two edges hemmed to one another have a distal end part that is folded against a body of the metal part along the hemming line, and wherein the hemming line includes at least a first section having a first thickness and a second section having a second thickness greater than the first thickness, and wherein the flattening module is configured to flatten the first and second sections by:

prior to the at least one pressing roller or each pressing roller being in contact with the hemming line, the at least one pressing actuator or each pressing actuator is configured to apply a predetermined pressure to the at least one pressing roller or each pressing roller such that the rotational guide bearing or each rotational guide bearing abuts against the lower bottom of the inner cavity or each inner cavity to determine an initial altitude of the at least one pressing roller or each pressing roller in the determined pressing direction taken relative to a reference surface, and when the at least one pressing roller or each pressing roller bears against a first section of the free surface, located at a first altitude greater than the initial altitude, the at least one pressing roller or each pressing roller is moved relative to the trolley in the direction opposite the determined pressing direction such that pressure exerted by the at least one pressing actuator or each pressing actuator on the at least one pressing roller or each pressing roller auto-adaptively increases to a first pressure, greater than the predetermined pressure, as a result of gas located in the sealed chamber or each sealed chamber being compressed due to the movement of the piston or each piston.

* * * * *